US005933871A

United States Patent [19]

Kraft

[11] Patent Number: 5,933,871

[45] Date of Patent: Aug. 10, 1999

[54] MODULAR HAT

[76] Inventor: David Kraft, 570 Yuma Ct., Boulder, Colo. 80301

[21] Appl. No.: 08/908,929

[22] Filed: Aug. 8, 1997

[51] Int. Cl.[6] ..... A42B 1/24

[52] U.S. Cl. ..... 2/209.13; 2/181.4; 2/906; 362/106

[58] Field of Search ..... 2/209.13, 906, 2/422, 181.4; 362/106, 107

[56] References Cited

U.S. PATENT DOCUMENTS

| | | | |
|---|---|---|---|
| D. 237,758 | 11/1975 | Huffman | D2/244 |
| 946,770 | 1/1910 | Sands . | |
| 1,114,400 | 10/1914 | Slotoroff | 2/195.1 |
| 1,194,193 | 8/1916 | Kronthal | 2/181 |
| 1,816,346 | 7/1931 | Silverstein | 2/209.12 |
| 3,268,911 | 8/1966 | Cox . | |
| 4,484,363 | 11/1984 | Varanese | 2/209.1 |
| 4,630,317 | 12/1986 | Brown et al. | 2/12 |
| 4,776,044 | 10/1988 | Makins | 2/199 |
| 5,046,195 | 9/1991 | Koritan | 2/172 |
| 5,070,545 | 12/1991 | Tapia | 2/195 |
| 5,099,524 | 3/1992 | Linday | 2/181 |
| 5,102,024 | 4/1992 | Boersma et al. | 2/209.13 |
| 5,121,507 | 6/1992 | Brown | 2/199 |
| 5,161,259 | 11/1992 | Shorts | 2/199 |
| 5,253,368 | 10/1993 | Blake | 2/209.13 |
| 5,351,343 | 10/1994 | Harbison | 2/172 |
| 5,428,844 | 7/1995 | Dougherty | 2/181.4 |
| 5,437,062 | 8/1995 | Douglas | 2/195.1 |
| 5,493,735 | 2/1996 | Rice | 2/209.13 |
| 5,685,017 | 11/1997 | Kraft | 2/209.13 |

FOREIGN PATENT DOCUMENTS

| | | | |
|---|---|---|---|
| 2070413 A | 9/1981 | United Kingdom | 2/209.12 |
| 2240029 A | 7/1991 | United Kingdom | 2/10 |

*Primary Examiner*—Diana L. Biefeld
*Attorney, Agent, or Firm*—Aquilino & Welsh

[57] ABSTRACT

A modular hat is disclosed. The hat includes a hat crown having an inside perimeter, a front side, a back side, a left side, and a right side. A visor is attached to the front side of the hat crown. A headband connecting member is attached along the inside perimeter of the hat crown for releasably connecting a plurality of components to the hat, wherein the components are chosen from the group consisting of a chin strap, a sunglass mount, a one-piece ear muff attachment, a storm visor, an ear and neck winter guard, a hydration curtain, a pocket, a bug net, an internal headband, a reflective illuminator, a flashlight holder, a winter facemask with pockets, and an ornamental towel.

13 Claims, 10 Drawing Sheets

MODULAR HAT

BACKGROUND OF THE INVENTION

1. Field of the Invention

This invention relates to modular hats. More particularly, the invention relates to HATCESSORIES™, that is, modular hats including a wide-range of components for selective attachment to a base headband.

2. Description of the Prior Art

Hats have always been a very popular addition to the clothing worn by individuals. Hats have principly been worn for functional reasons, for example, to keep an individual's head warm or to protect an individual's face from the sun. However, hats have also been used as a stylish accessory to the clothing worn by an individual. For this reason, hats are available with wide brims and neck curtains providing protection from the sun, with insulated crowns and ear muffs providing protection from the cold, and in a wide variety of colors and styles fulfilling the aesthetic demands of the public. Since the majority of these hats are designed for a specific purpose and are not readily adaptable, people must purchase a wide variety of hats to meet their functional and stylistic needs.

With this in mind, adaptable hats, permitting an individual to add and remove components from a base hat, have been known for some time. These hats may, for example, permit an individual to add different visors or neck curtains to the hat. These hats may also permit the selective addition and removal of different hat crowns, emblems, or other components.

The provision of hats that may be readily modified provides individuals with the ability to modify their hats based upon outdoor conditions or simply a change of mood. As a result, an individual need not purchase an excessive number of hats to meet the wide variety of needs he or she may have.

However, prior convertible hats are limited in the versatility provided to wearers. For example, a hat may provide the ability to apply a variety of visors thereto, but not provide the ability to apply a variety of hat crowns thereto. Similarly, prior convertible hats might permit different hat crowns to be applied thereto, but not permit the panels of a specific hat crown to be interchanged. In addition, the manner in which the components are secured to the base hat is often cumbersome and insecure in prior convertible hats. This limits the usefulness of the hats, since individuals must consistently be concerned whether the attached components will in fact fall from the base hat.

In view of the shortcomings of prior convertible hats, a modular hat providing complete versatility with a secure attachment mechanism is needed. The present modular hat provides for an unlimited range of versatility in a convenient, reliable, easy to use, and inexpensive modular design.

SUMMARY OF THE INVENTION

It is, therefore, an object of the present invention to provide a modular hat. The hat includes a hat crown having an inside perimeter, a front side, a back side, a left side, and a right side. A visor is attached to the front side of the hat crown. A headband connecting member is attached along the inside perimeter of the hat crown for releasably connecting a plurality of components to the hat, wherein the components are chosen from the group consisting of a chin strap, a sunglass mount, a one-piece ear muff attachment, a storm visor, an ear and neck winter guard, a hydration curtain, a pocket, a bug net, an internal headband, a reflective illuminator, a flashlight holder, a winter facemask with pockets, and an ornamental towel.

It is also an object of the present invention to provide a modular hat including a chin strap having a string with a first end, a second end, a first fastening member attached to the first end of the string, a second fastening member attached to the second end of the string, and an adjustment clamp attached to the chin strap. The first and second fastening members releasably secure the chin strap to the headband connecting member such that the user may adjust the chin strap to secure the hat in position.

It is another object of the present invention to provide a modular hat including a sunglass mount having a first resilient cord and a second resilient cord. The first cord has a first end, a second end, a first fastening member attached to the first end of the first cord, and a first loop formed at the second end of the first cord for releasable attachment to the modular hat. The second cord has a first end, a second end, a second fastening member attached to the first end of the second cord for releasable attachment to the modular hat, and a second loop formed at the second end of the second cord. In use, the first loop is used to attach the first cord to a right arm of a pair of sunglasses and the second loop is used to attach the second cord to a left arm of a pair of sunglasses, such that the user may simultaneously wear the hat and sunglasses.

It is a further object of the present invention to provide a modular hat including an ear muff attachment having a proximal end, a distal end, and an adjustment gap flap attached to the proximal end of the ear muff attachment.

It is also an object of the present invention to provide a modular hat including a storm visor having a proximal end, a distal end, an adjustment gap flap attached to the proximal end of the storm visor, a semi-rigid support member attached to the distal end of the storm visor, and a connecting member secured to the proximal end of the storm visor.

It is another object of the present invention to provide a modular hat including an ear and neck winter guard having a proximal end, a distal end, an outer surface, an inner surface, a first neck guard extension, a second neck guard extension, a proximal end connecting member secured to the proximal end of the ear and neck winter guard, a first neck guard extension connecting member secured to the first neck guard extension, and a second neck guard extension connecting member secured to the second neck guard extension. In use, the proximal end connecting member and the first and second neck guard extension connecting members are used to secure the guard to the headband connecting member such that the winter guard extends downwardly and forwardly over the ears of the user, wrapping around the neck of the user.

It is a further object of the present invention to provide a modular hat including a hydration curtain having a distal end, a proximal end, and a connecting member attached to the proximal end of the hydration curtain.

It is also an object of the present invention to provide a modular hat including a pocket having a lower end, an upper end, a connecting member attached to the lower end of the pocket, and an opening near the upper end of the pocket. The connecting member located at the lower end of the pocket is used to releasably secure the pocket to the headband connecting member such that the pocket extends upwardly along the inside of the hat crown.

It is another object of the present invention to provide a modular hat including a bug net formed from a mesh material.

It is a further object of the present invention to provide a modular hat including an internal headband having an absorbent strip with a first side, a second side, and a connecting member attached to the second side of the strip. The connecting member of the internal headband is used to releasably secure the internal headband to the headband connecting member such that the hat secures the first side of the internal headband in place against the user's head.

It is also an object of the present invention to provide a modular hat including a reflective illuminator having a flexible strip with a first reflective side, a second side, and a connecting member, wherein the connecting member is releasably secured to the headband connecting member such that the first reflective side faces outwardly.

It is another object of the present invention to provide a modular hat including a flashlight holder having a first edge, a second edge, and a connecting member attached to the first edge of the flashlight holder. The connecting member is used to releasably attach the flashlight holder to the headband connecting member.

It is a further object of the present invention to provide a modular hat including a winter facemask having a first pocket, a second pocket, a first corner, a second corner, a first connecting member attached to the first corner, and a second connecting member attached to the second corner. The first and second connecting members are used to releasably attach the facemask to the headband connecting member such that the headband extends downwardly and the first and second pockets are aligned with the left and right ear of the user, respectively.

It is also an object of the present invention to provide a modular hat including an ornamental towel having a proximal edge, a distal edge, and a connecting member attached to the proximal edge of the towel, wherein the connecting member is used to secure the towel to the headband connecting member of the hat.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
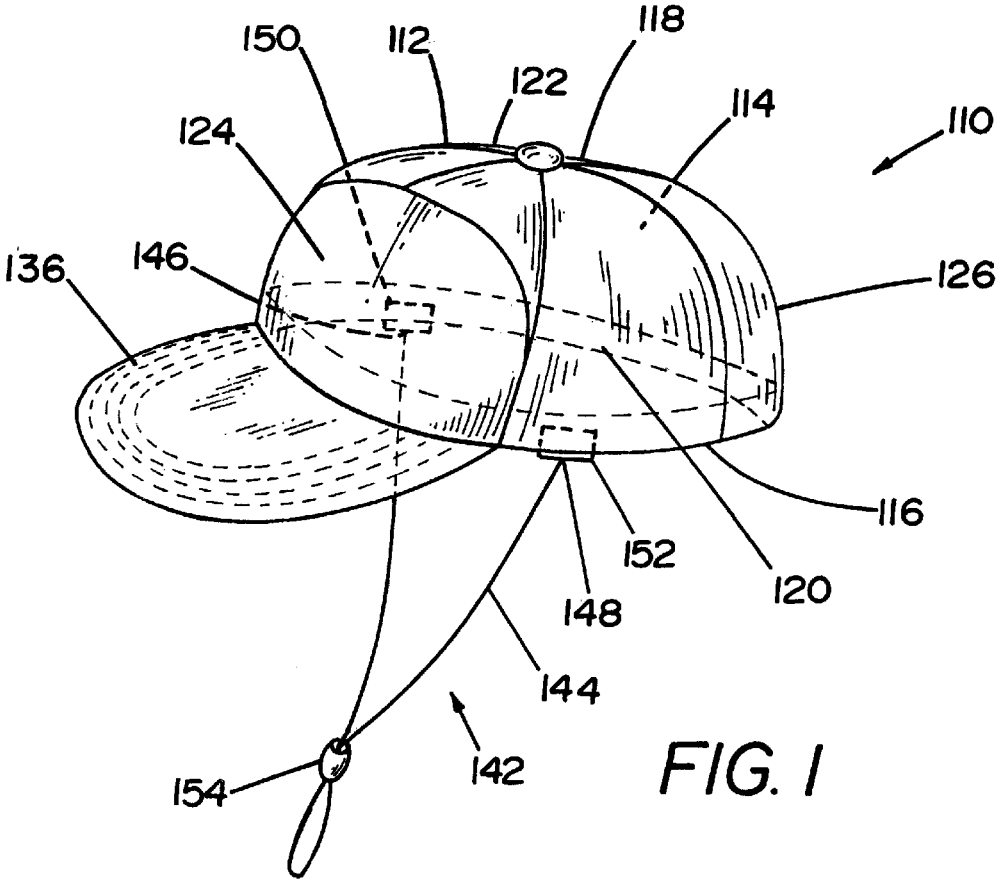
FIG. 1 is a perspective view of the modular hat having a chin strap attached to the headband connecting member.
Figure 2:
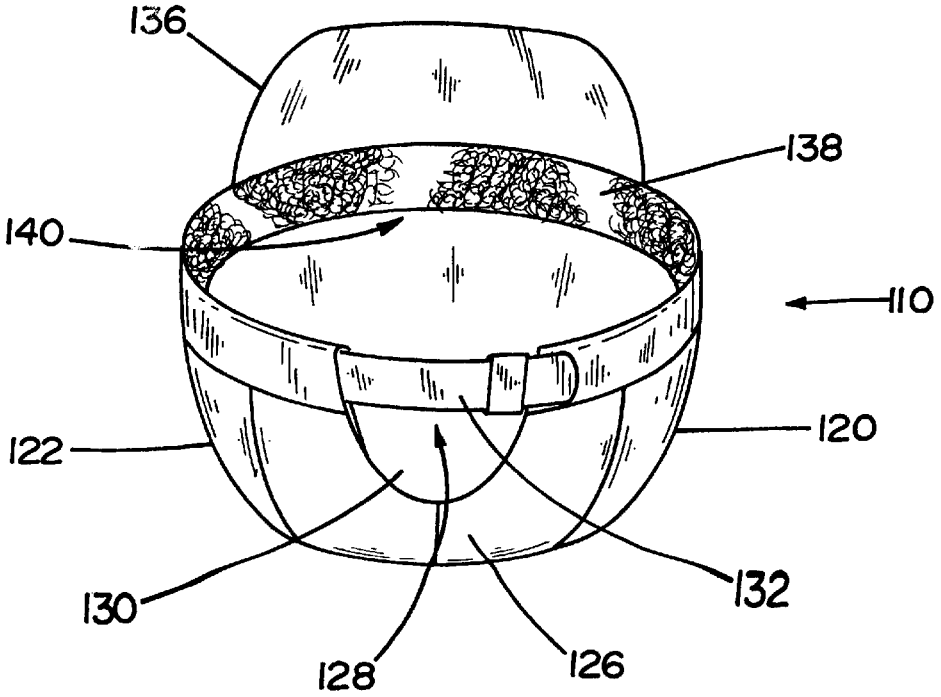
FIG. 2 is a bottom view of the modular hat with an adjustment member.

A modular hat 110 is shown in FIGS. 1 and 2. The modular hat includes a hat crown 112 having an inner surface 114 shaped to fit about the circumference of a user's head. The hat crown 112 further includes an open end 116 and a closed end 118. The open end 116 is shaped to fit about the circumference of an individual's head. The hat crown 112 also has four sides. Specifically, the hat crown 112 includes a left side 120, a right side 122, a front side 124, and a back side 126. The four sides of the hat crown 112 are contoured such that the hat crown 112 covers the user's head when the hat is worn. The left side 120, right side 122, and front side 124 are composed of a plurality of solid panels.

The back side 126, also composed of a plurality of panels, includes an adjustment member 128. The adjustment member 128 includes an adjustment gap 130 and an adjustment gap strap 132. The adjustment gap 130 allows the hat to be expanded or contracted, depending on the size of the user's head, to fit the user's head. The gap strap 132 holds the hat at a constant size.

Attached to the front 124 of the hat is a visor 136. The visor 136 is attached to the bottom front side of the hat crown 112 such that the visor 136 extends outwardly with respect to the front side 124 of the hat crown 112.

As seen in FIG. 2, the modular hat 110 also includes a headband connecting member 138. The headband connecting member 138 is attached to the inside perimeter 140 of the hat crown 112, adjacent the open end 116 of the hat crown 112. The headband connecting member 138 is preferably fabricated from a one to two inch wide loop-type material strip (for example, VELCRO hook and loop connecting material), and is connected to the perimeter 140 such that the loop-type material faces inwardly toward the user's head. The headband connecting member 138 covers the entire inside perimeter 140 of the modular hat 110, excluding the adjustment gap 130 in the back side 126 of the hat. The headband connecting member 138 is used for releasably connecting a plurality of components to the modular hat, wherein the components may be chosen from the group consisting of a chin strap 142, a sunglass mount 156, a one-piece ear muff attachment 180, a storm visor 194, an ear and neck winter guard 206, a hydration curtain 228 with silicon pockets 236, 238, a pocket 240, a bug net 250, an internal headband 264, a reflective illuminator 270, a flashlight holder 282, a winter facemask with pockets 288, and an ornamental towel 322. The modular hat is capable of securing and supporting up to eight of these components at one time.

With reference to FIG. 1, the chin strap 142 includes a string 144 having a first end 146, a second end 148, a first fastening member 150 attached to the first end 146, a second fastening member 152 attached to the second end 148, and an adjustment clamp 154 attached to the chin strap 142. The first and second fastening members 150, 152 are preferably fabricated from a strip of VELCRO hook-type material. The first and second fastening members 150, 152 are used to secure the chin strap 142 to the headband connecting member 138. While wearing the modular hat with the attached chin strap 142, the user may adjust the chin strap under the user's chin to secure the modular hat in position on the user's head.

Figure 3:
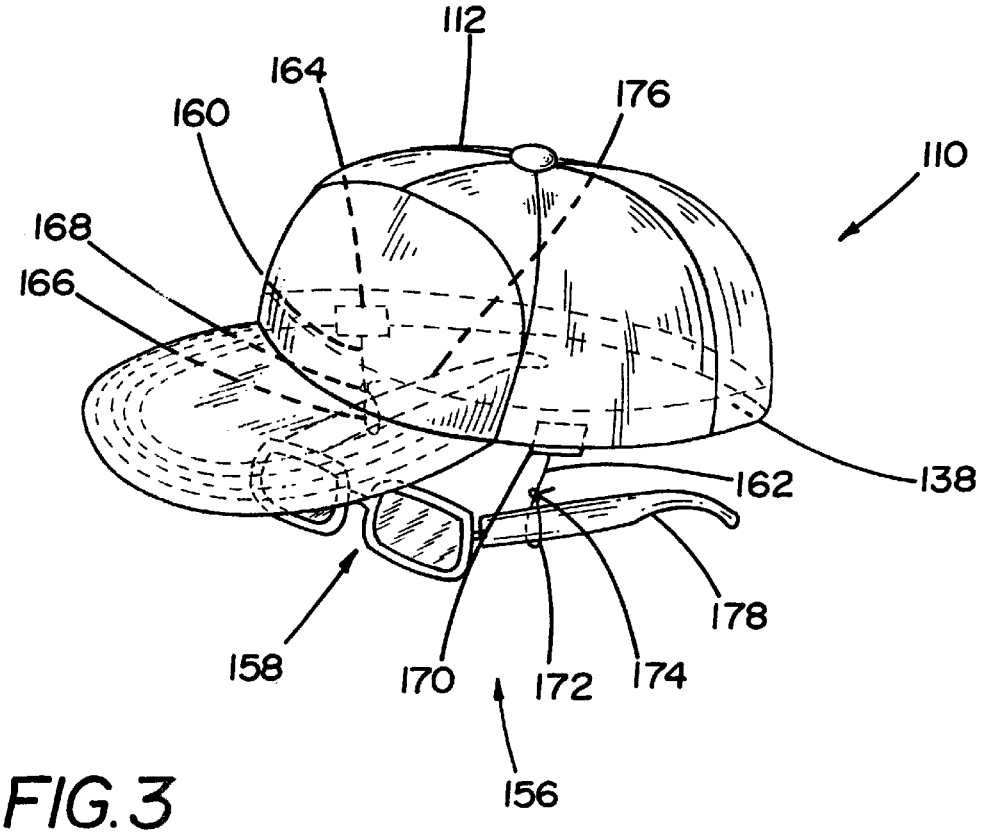
FIG. 3 is a partial view of the sunglass mount releasably attached to sunglasses and a modular hat.

The sun glass mount 156, as seen in FIG. 3, secures sunglasses 158 to the modular hat 110 such that the user will not lose the sunglasses 158 during use. The sunglass mount 156 includes a first rubber-like cord 160 and a second rubber-like cord 162. The first cord 160 includes a first fastening member 164 attached to the first end of the first cord 160. The first cord 160 also includes a loop 166 formed by the second end of the first cord 160, secured by a first loop adjustment mechanism 168. The second cord 162 includes a second fastening member 170 attached to the first end of the second cord 162. The second cord 162 also includes a loop 172 formed by the second end of the second cord 162, secured by a second loop adjustment mechanism 174. The first and second fastening members 164, 170 are preferably fabricated from a strip of VELCRO hook-type material. The first and second loop adjustment mechanisms 168, 174, ring-shaped devices, are attached to the first cord 160 and second cord 162, respectively, and are used to maintain the first loop 166 and second loop 172, respectively, at a desired size. The user adjusts the size of the loops to accommodate the specific pair of sunglasses 158 being worn. When used in conjunction with the hat, the first loop 166 is secured around the right sunglass arm 176, and the second loop 172 is secured around the left sunglass arm 178. The first and second fastening members 164, 170 are then releasably attached to the right and left side, respectively, of the headband connecting member 138 of the hat 110. The user may then simultaneously wear the hat 110 and sunglasses 158.

Figure 4:
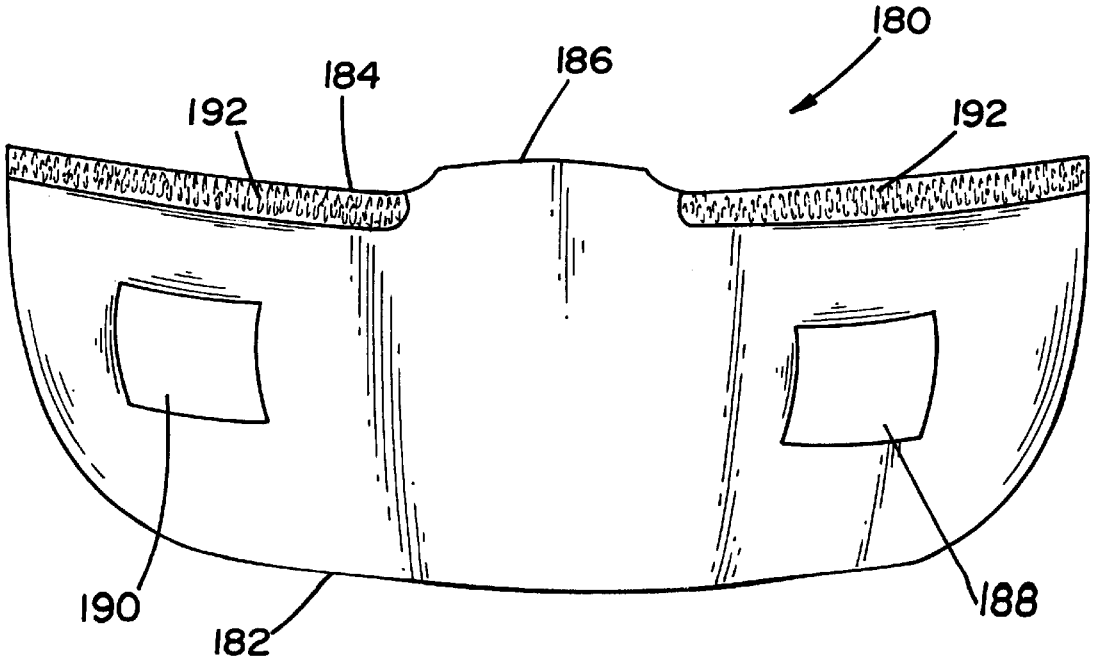
FIG. 4 is a plan view of the ear muff attachment.

FIG. 4 shows a one-piece ear muff attachment 180. The ear muff attachment 180 includes a curved distal end 182 which extends downwardly over the user's ears when the ear muff attachment 180 is secured to the hat being worn by the user. The ear muff attachment 180 also includes a proximal end 184 having an adjustment gap flap 186, a first pocket 188, a second pocket 190, and a plurality of connecting members 192 secured to the proximal end 184 of the ear muff attachment 180.

The connecting members 192 are used to secure the ear muff attachment 180 to the headband connecting 138 member of the hat 110, such that the ear muff attachment 180 extends over the ears of the user. The ear muff connecting members 192 are preferably made from the VELCRO hook-type material, thereby enabling the ear muff attachment 180 to be releasably secured to the headband connecting member 138 of the hat 110.

Figure 5:
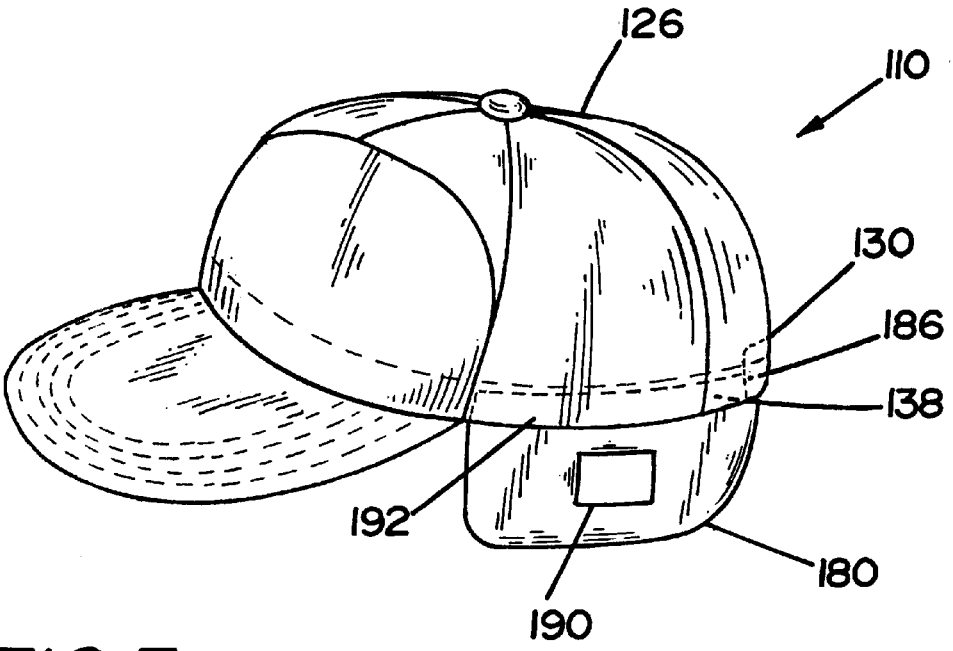
FIG. 5 is a perspective view of the ear muff attachment releasably attached to the modular hat.

When the ear muff attachment 180 is secured to the hat 110, as shown in FIG. 5, the adjustment gap flap 186 is positioned over the adjustment gap 130 in the back side 126 of the hat 110, thereby preventing inclement weather from entering the empty space between the user's head and the hat through the adjustment gap 130 in the back side 126 of the hat. Also, the first pocket 188 is located adjacent one of the user's ears, and the second pocket 190 is located adjacent the user's other ear. The user may insert the user's ears or other objects into the pockets during use.

Figure 6:
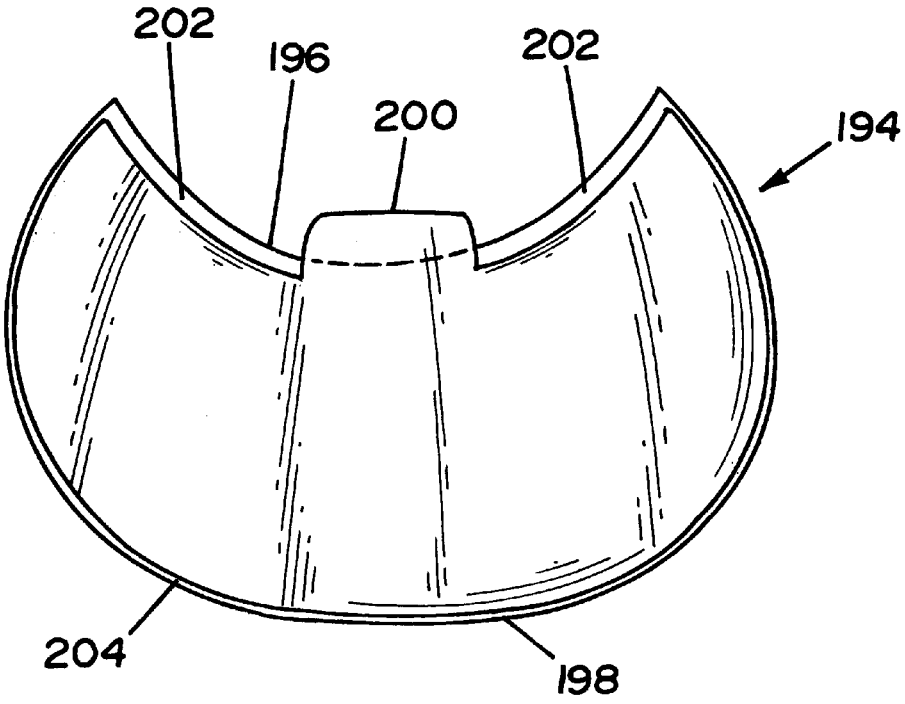
FIG. 6 is a plan view of the storm visor.

A storm visor 194 is shown in FIG. 6. The storm visor includes a proximal end 196, a distal end 198, an adjustment gap flap 200 attached to the proximal end 196 of the storm visor 194, and a plurality of connecting members 202 secured to the proximal end 196 of the storm visor 194. The storm visor 194 also includes a semi-rigid support member 204 attached along the edge of the distal end 198 of the storm visor 194.

Figure 7:
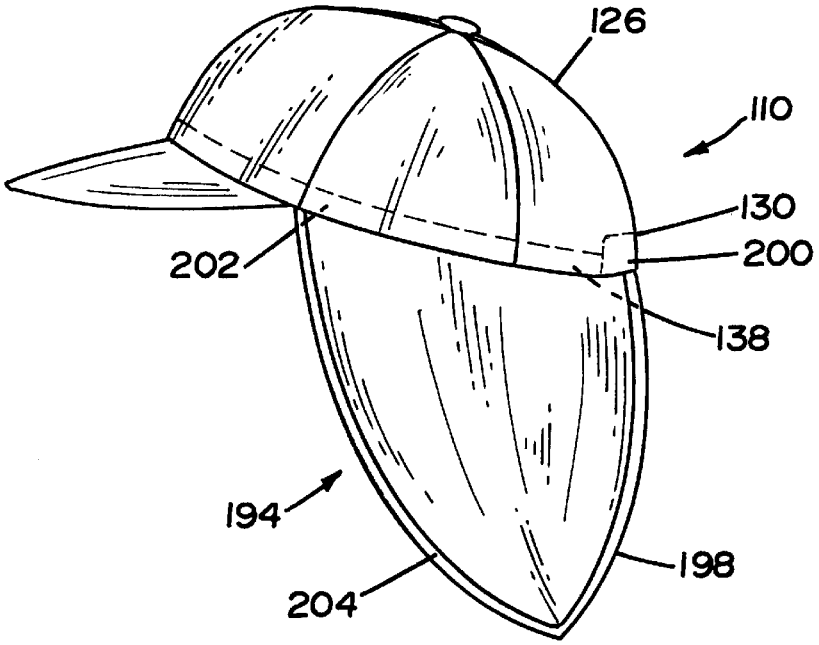
FIG. 7 is a perspective view of the storm visor releasably attached to the modular hat.

In use, the connecting members 202 are used to secure the storm visor 194 to the headband connecting 138 member of the hat 110 such that the storm visor 194 extends downwardly, from the hat 110, over the neck of the individual wearing the modular hat 110. The storm visor connecting members 202 are preferably made from the VELCRO hook-type material, thereby enabling the storm visor attachment 194 to be releasably secured to the headband connecting member 138 of the hat 110, as shown in FIG. 7. The semi-rigid support member 198 holds the distal end 204 of the visor 194 in a downward position to prevent inclement weather from contacting the back and sides of the user's neck. The adjustment gap flap 200 is positioned over the adjustment gap 130 in the back side 126 of the hat 110, thereby preventing inclement weather from entering the empty space between the user's head and the hat through the adjustment gap 130 in the back of the hat 110.

Figure 8:
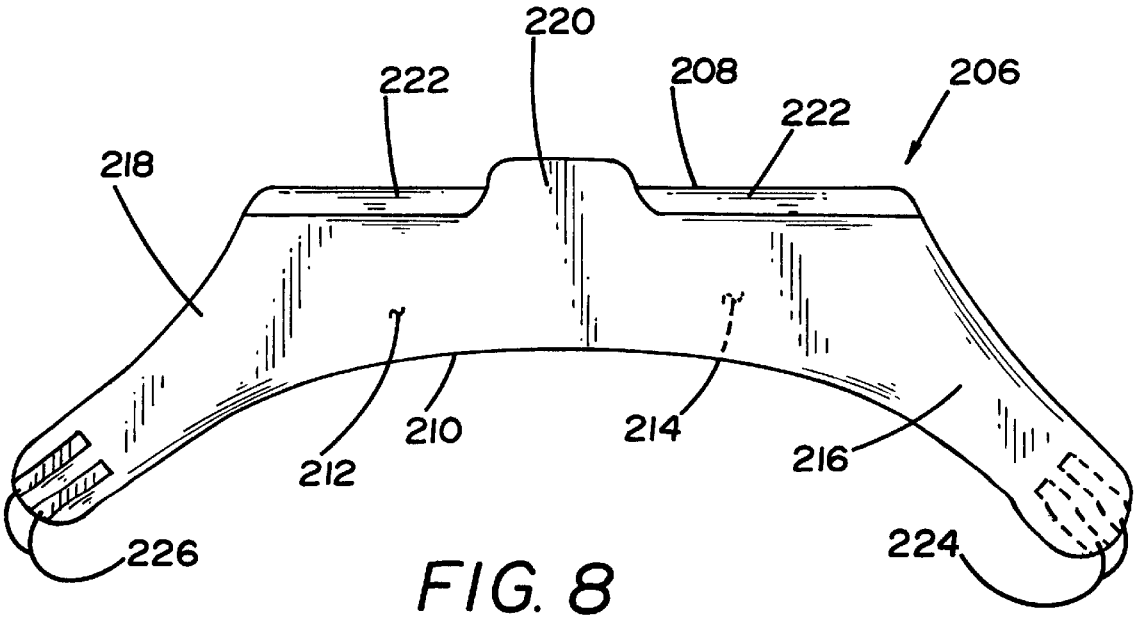
FIG. 8 is a plan view of the ear and neck winter guard.

FIG. 8 discloses an ear and neck winter guard 206. The guard 206 includes a proximal end 208, a distal end 210, an outer surface, and an inner surface 214. The guard 206 also includes a first neck guard extension 216, a second neck guard extension 218, and an adjustment gap flap 220 attached to the proximal end 208 of the guard 206. The guard 206 also includes a plurality of proximal end connecting members 222 secured to the proximal end 208 of the guard 206, a first connecting member 224 secured to the end of the first neck guard extension 216, and a second connecting member 226 secured to the end of the second neck guard extension 218.

Figure 9:
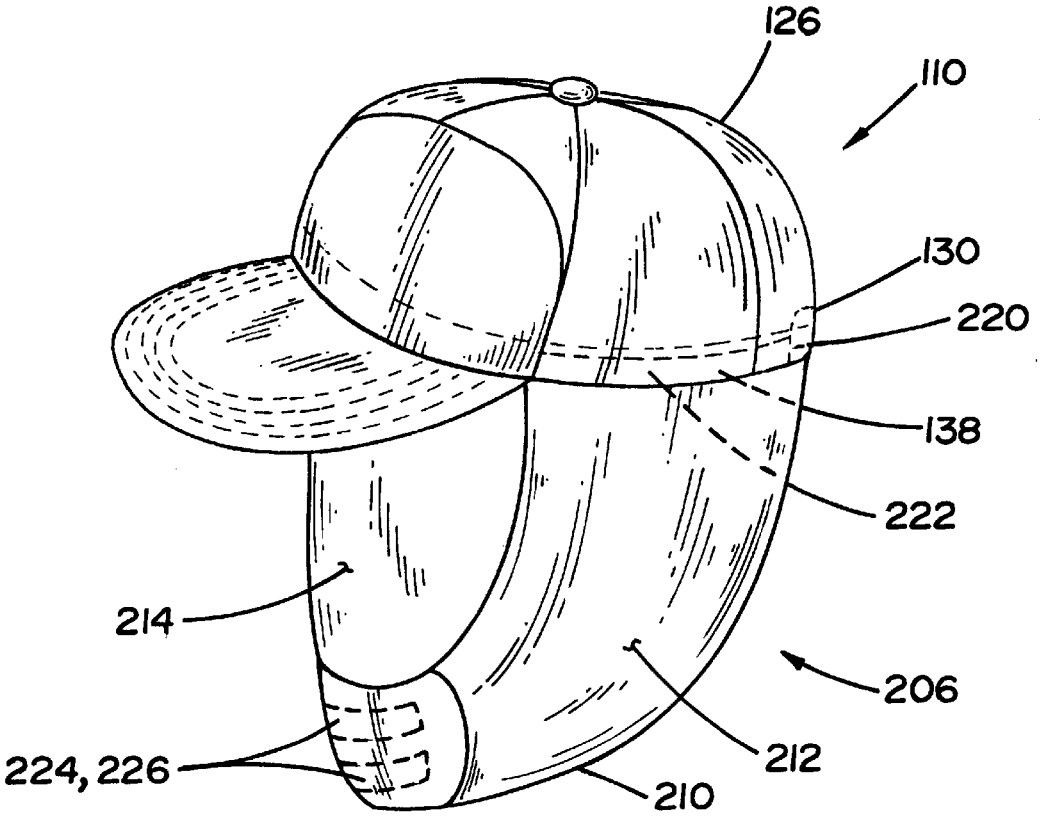
FIG. 9 is a perspective view showing the ear and neck winter guard releasably attached to the hat.

In use, as shown in FIG. 9, the proximal end connecting members 222 secured to the proximal end 208 of the guard 206 releasably couple the winter guard 206 to the headband connecting member 138 of the hat 110 such that the winter guard 206 extends downwardly, from the hat 110, over the ears of the individual. The proximal end connecting members 222 are preferably made from the VELCRO hook-type material, thereby enabling the guard 206 to be releasably secured to the headband connecting member 138 of the hat 110. The first and second neck guard extensions 216, 218 extend downwardly and forwardly, wrapping around the individual's neck. As seen in FIG. 8, the first connecting member 224 on the first neck guard extension 216 is located on the inner surface 214 of the guard 206, and the second connecting member 226 on the second neck guard extension 218 is located on the outer surface 212 of the guard 206. The first and second connecting members 224, 226 are preferably made of the VELCRO hook and loop type material, respectively, thereby enabling a user to releasably attach, at the front of the user's neck, the first extension 216 to the second extension 218 when the extensions are wrapped around the user's neck. The adjustment gap flap 220 is positioned over the adjustment gap 130 in the back 126 of the hat 110, thereby preventing inclement weather from entering the empty space between the user's head and the hat 110 through the adjustment gap 130 in the back 126 of the hat 110.

Figure 10:
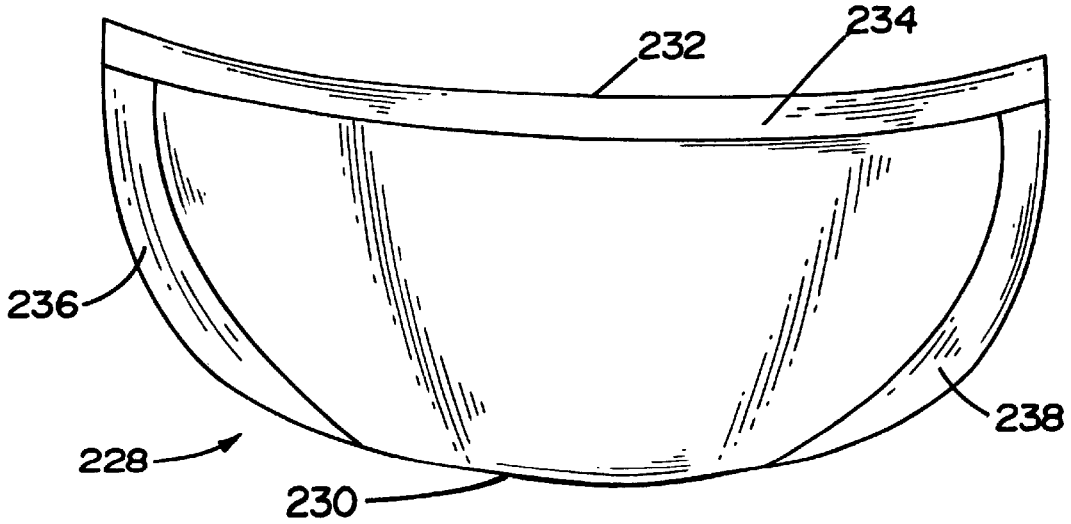
FIG. 10 is a plan view of the summer hydration unit with silicon pockets.

FIG. 10 shows a summer hydration curtain 228. The summer hydration curtain 228 includes a distal end 230, a proximal end 232, a connecting member 234 secured to the proximal end 232, a first silicon pocket 236 located along the distal end 230 of the curtain 228, and a second silicon pocket 238 located along the distal end 230 of the curtain 228. The connecting member 234 is preferably made of VELCRO hook-type material.

In use, the connecting member 234 located at the proximal end 232 of the curtain 228 is used to secure the curtain 228 to the headband connecting member 138 of the hat 110 such that the curtain 228 extends downwardly, from the hat, over the ears and neck of the user. The silicon in the first silicon pocket 236 and second silicon pocket 238 absorbs and releases water. The evaporating water cools the user wearing the hat.

Figure 11:
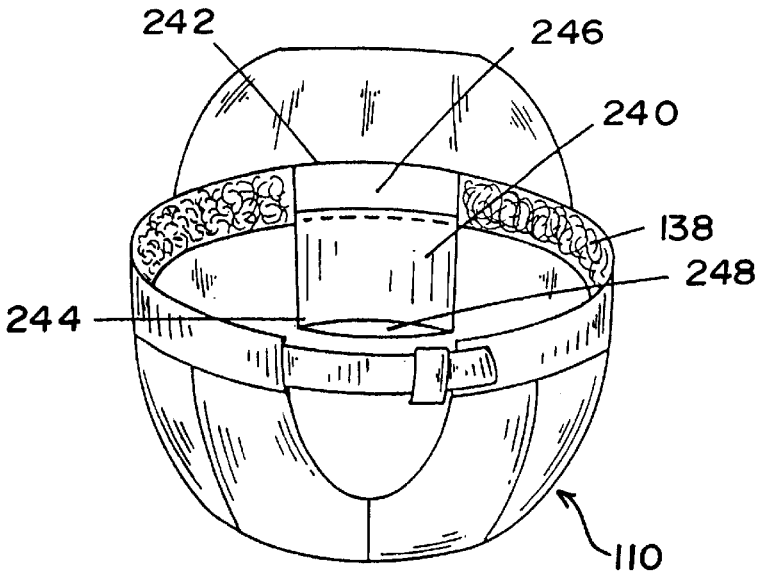
FIG. 11 is a perspective view of a pocket releasably attached to the modular hat.

In FIG. 11, a pocket 240 is attached to the headband connecting member 138 of the hat 110. The pocket 240 includes a lower end 242, an upper end 244, a connecting member 246 attached to the lower end 242, and an opening 248 near the upper end 244. The connecting member 246 is preferably made of the VELCRO hook-type material. In use, the connecting member 246 located at the lower end 242 of the pocket 240 releasably secures the pocket 240 to the headband connecting member 138 of the hat 110 such that the pocket 240 extends upwardly along the inside of the hat. A user may insert any one of a variety of items into the pocket 240 through the opening 248 at the top 244 of the pocket 240. The user may wear the hat 110 with the item safely stored in the pocket 240.

Figure 12:
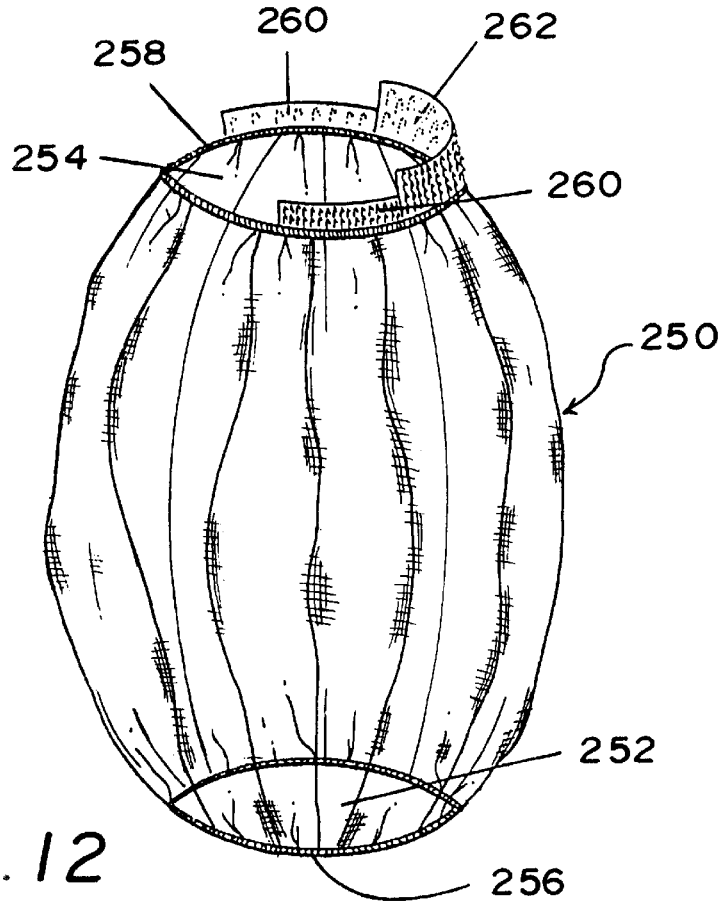
FIG. 12 is a plan view of the bug net.

FIG. 12 discloses a bug net 250 to be used with the hat 110. The bug net 250, a tubular-shaped attachment, is fabricated preferably from a lightweight mesh cloth. The tubular bug net 250 includes a lower open end 252 and an upper open end 254. The bug net 250 also includes a first elastic-type element 256 secured around the perimeter of the lower open end 252 and a second elastic-type element 258 secured around the perimeter of the upper open end 254. Additionally, the bug net 250 includes a plurality of connecting members 260 attached near the perimeter of the upper open end 254. Finally, the bug net 250 includes an adjustment gap flap 262 secured to the perimeter of the upper open end 254.

Figure 13:
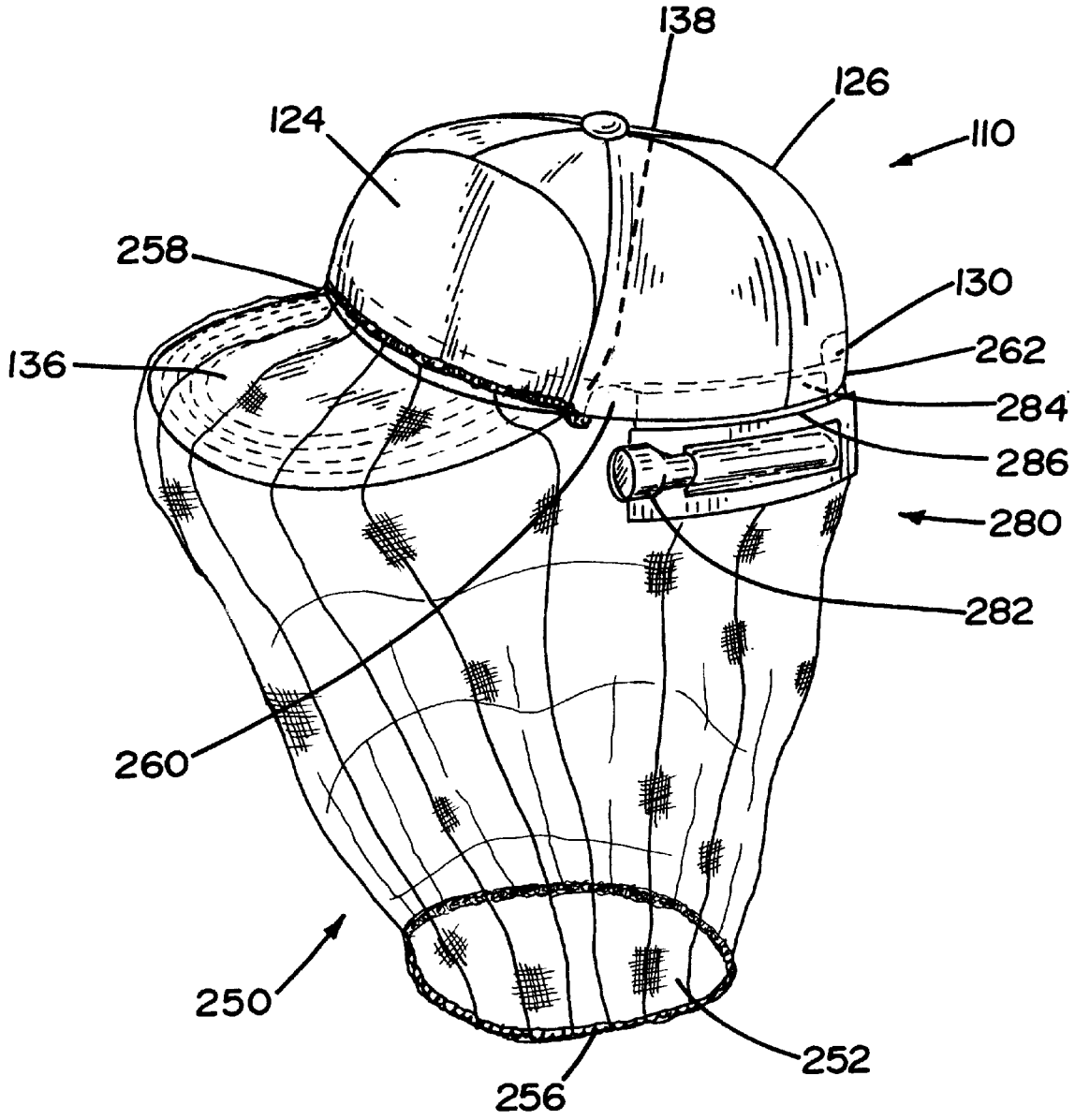
FIG. 13 is a perspective view of the bug net and the flashlight holder attached to the modular hat.

The connecting members 260 are preferably fabricated from double-sided VELCRO hook and loop-type material having the hook material facing outwardly and the loop material facing inwardly. The connecting members 260 are sized and located on the upper open end 254 perimeter of the net 250. As a result, when the net 250 is attached to the headband connecting member 138 of the hat 110, the connecting members 260 attach to the right and left inside of the hat 110. Preferably, when the bug net 250 is attached to the headband connecting member 138 on the inside of the hat 110, as seen in FIG. 13, the connecting members 260 extend from the front side of the hat 124 to the edge of the hat adjustment gap flap 130, located at the back 126 of the hat 110. The edges of the hat adjustment gap flap 262 coincide with the end of the headband connecting member 138 on the inside of the hat 110. The adjustment gap flap 262, extending upwardly from the upper open end 254 perimeter, is positioned over the hat gap flap 130, thereby preventing bugs from entering through the adjustment gap 130 into the space between the hat and the user's head.

The remaining elasticized section 258 of the upper perimeter is positioned over the visor 136. The elastic-type element 258 securely holds the upper perimeter against the hat 110 along the proximal edge of the visor 136. The distal edge of the visor supports the bug net away from the user's face. The tubular body of the bug net 250 is positioned around the user's face, lower head and neck. The elasticized perimeter of the lower open end 252 of the bug net secures the lower open end around the bottom of the user's neck, thereby preventing bugs from landing on the user's neck, face and head.

Figure 14:
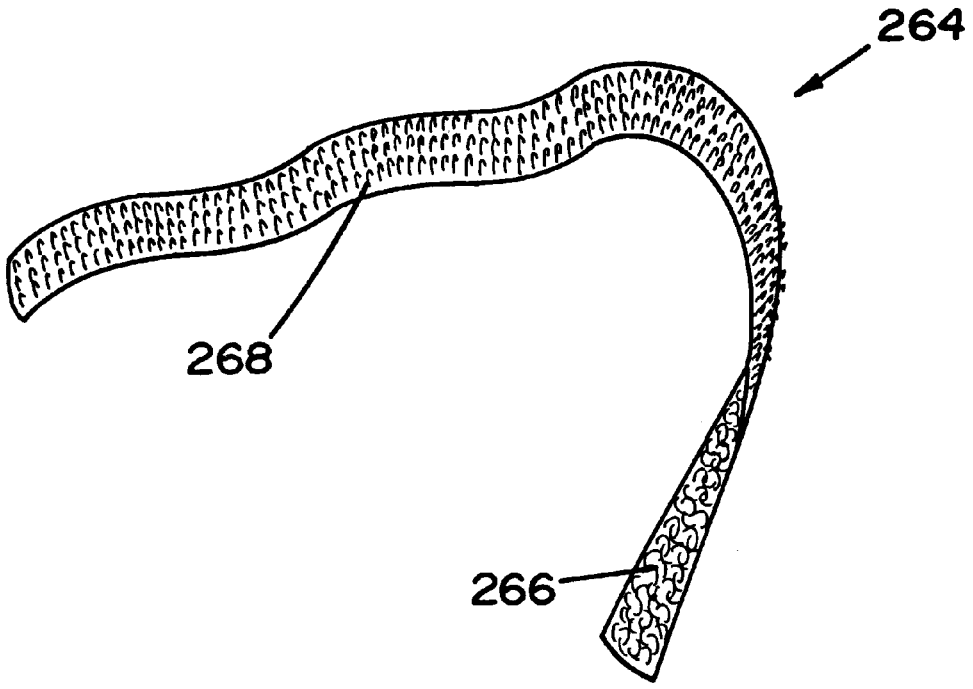
FIG. 14 is a perspective view of an internal headband constructed to attach to the modular hat.

FIG. 14 shows an internal headband 264 constructed for use with the hat 110. The headband 264 includes a narrow strip 266 of absorbent cloth having a connecting member 268 attached to one side of the strip 266. The length of the headband 264 is approximately equal to the inside perimeter of the hat. The connecting member 268, preferably VELCRO hook-type material, covers the entire length of one side of the headband 254. In use, the connecting member 268 of the headband 264 is attached to the headband connecting member 138 on the inside perimeter of the hat 110. The absorbent strip 266, positioned against the user's head, absorbs perspiration while the hat is in place on the user's head.

Figure 15:
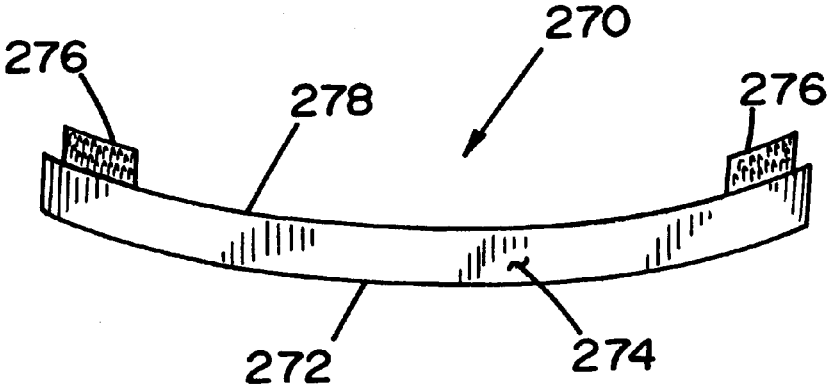
FIG. 15 is a plan view of a reflective illuminator.

A reflective illuminator 270 is shown in FIG. 15. The illuminator 270 includes a narrow strip 272 of material having a reflective surface 274 on at least one side of the strip 272. The illuminator 270 also includes a plurality of connecting members 276 secured to, and extending away from, one long edge 278 of the reflective strip 272. The connecting members 276 are preferably constructed from VELCRO hook-type material. In use, the connecting members 276 are secured to the headband connecting member 138 on the inside perimeter of the hat 110 such that the reflective strip 272 is positioned adjacent the perimeter of the hat 110. The reflective surface 274 faces outwardly, away from the user's head, thereby reflecting any light incident upon the outer surface.

A flashlight holder 280, including a flashlight 282, attached to the hat 110 is disclosed in FIG. 13. The pocket-type flashlight holder 280 includes a connecting member 284 attached to a first edge 286 of the flashlight holder 280. The connecting member 284, preferably VELCRO hook-type material, is used to releasably attach the flashlight holder 280 to the inside headband connecting member 138 of the hat 110. With the releasable connecting member 284, the user can attach the holder 280 to the modular hat 110 such that the flashlight beam is directed in a desired direction with respect to the user's line of sight.

Figure 16:
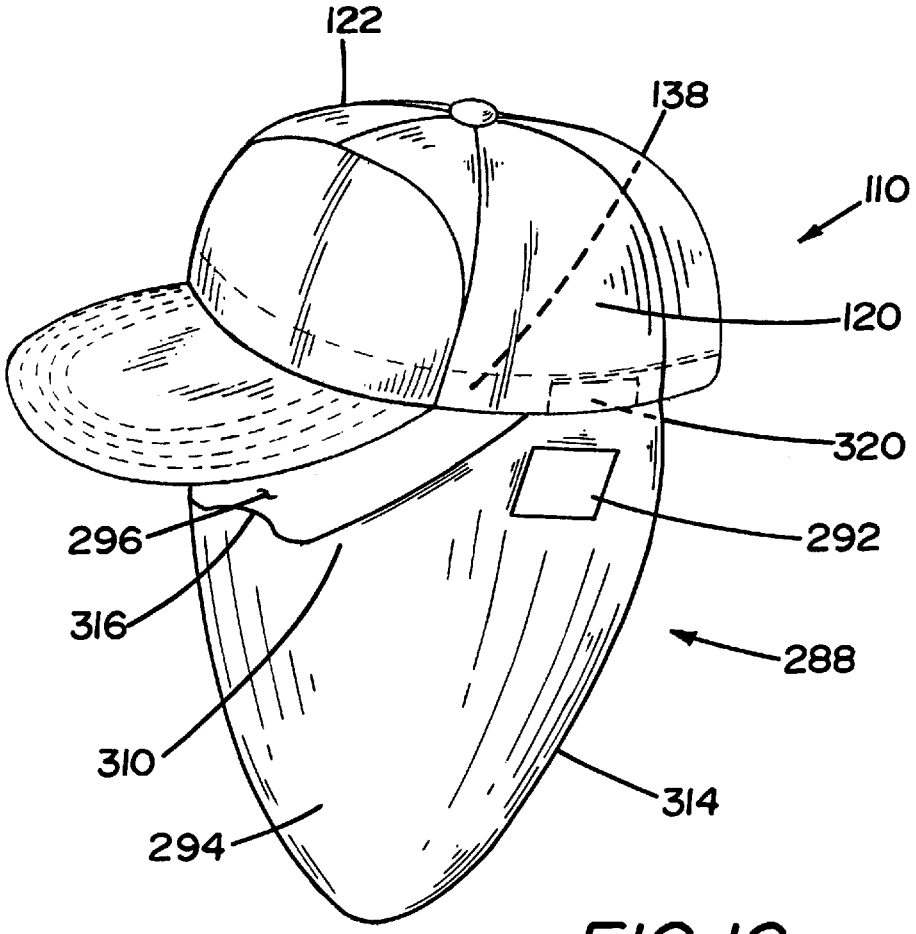
FIG. 16 is a perspective view of a winter facemask with pockets attached to the modular hat.
Figure 17:
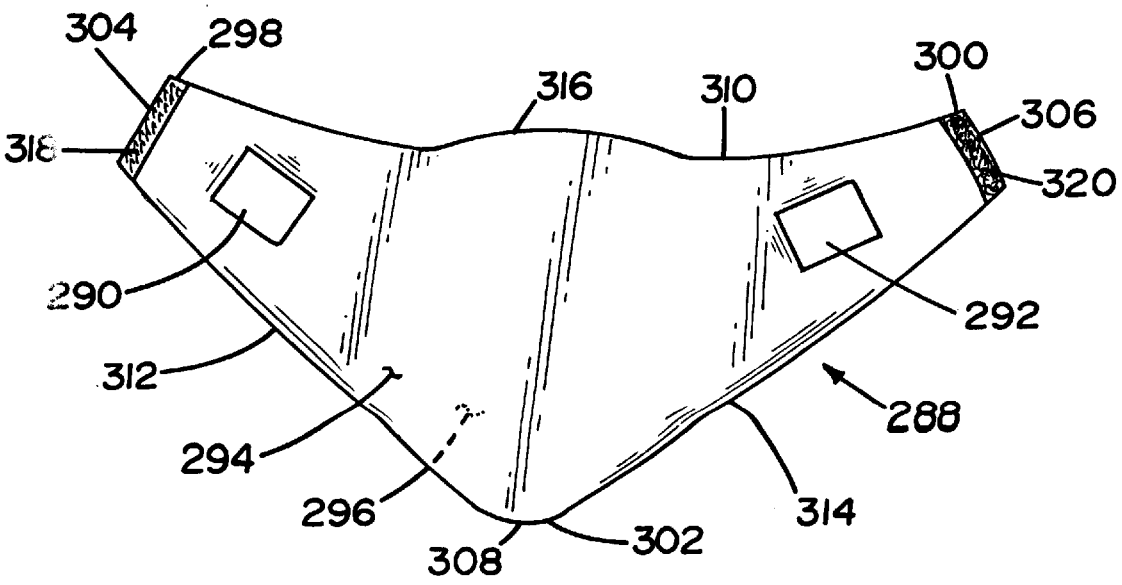
FIG. 17 is a plan view of the winter facemask with pockets.

A winter facemask 288 having a first pocket 290 and a second pocket 292 located near the ears is shown in FIGS. 16 and 17. The facemask 288, shown again in FIG. 18, includes a triangular-shaped material having an outer surface 294, an inner surface 296, a first corner 298, a second corner 300, and a third corner 302. The first corner 298 and second corner 300 have a first flat edge 304 and a second flat edge 306, respectively. The third corner 302 has a rounded shape 308. The facemask 288 also includes a first edge 310, a second edge 312, and a third edge 314. The first edge 310 of the triangular facemask 288, connecting the first corner 298 to the second corner 300, is curved inwardly, but has an outwardly projecting arc 316 in the center of the edge 310, located at approximately the midpoint between the first corner 298 and the second corner 300. The second edge 312 and third edge 314, located between the first corner 298 and third corner 302 and between the second corner 300 and third corner 302, respectively, are straight edges. Additionally, the facemask 288 includes a first connecting member 318 attached on the outer surface 294 of the facemask 288 near the first corner 298 and a second connecting member 320 attached on the outer surface 294 of the facemask 288 near the second corner 300 of the facemask 288. The first connecting member 318 and second connecting member 320 are preferably made from VELCRO hook-type material.

The user attaches the facemask 288 to the headband connecting member 138 of the hat 110 using the first connecting member 318 and second connecting member 320 on the facemask 288. The first facemask connecting member 318 is attached to the right side 122 of the hat 110, and the second connecting member 320 is attached to the left side 120 of the hat 110. The second edge 312 and third edge 314 of the facemask 288 extend downwardly and forwardly, such that the facemask 288 covers the user's face, and the rounded third corner 302 covers the front of the user's neck. The first edge 310 of the facemask 288 is positioned across the user's face, such that the outwardly projecting arc 316 on the first edge 310 of the facemask 288 extends upwardly to cover the user's nose. The facemask 288 covers the user's face from a point just below the user's eyes to a point at the bottom of the user's neck. When the facemask 288 is attached to the hat 110, as seen in FIG. 16, the facemask pockets 290, 292 are located at positions adjacent the user's ears. The first pocket 290 is located adjacent the user's right ear, and the second pocket 292 is located adjacent the user's left ear. The user may choose to insert a variety of items, including earphones, into the pockets.

Figure 18:
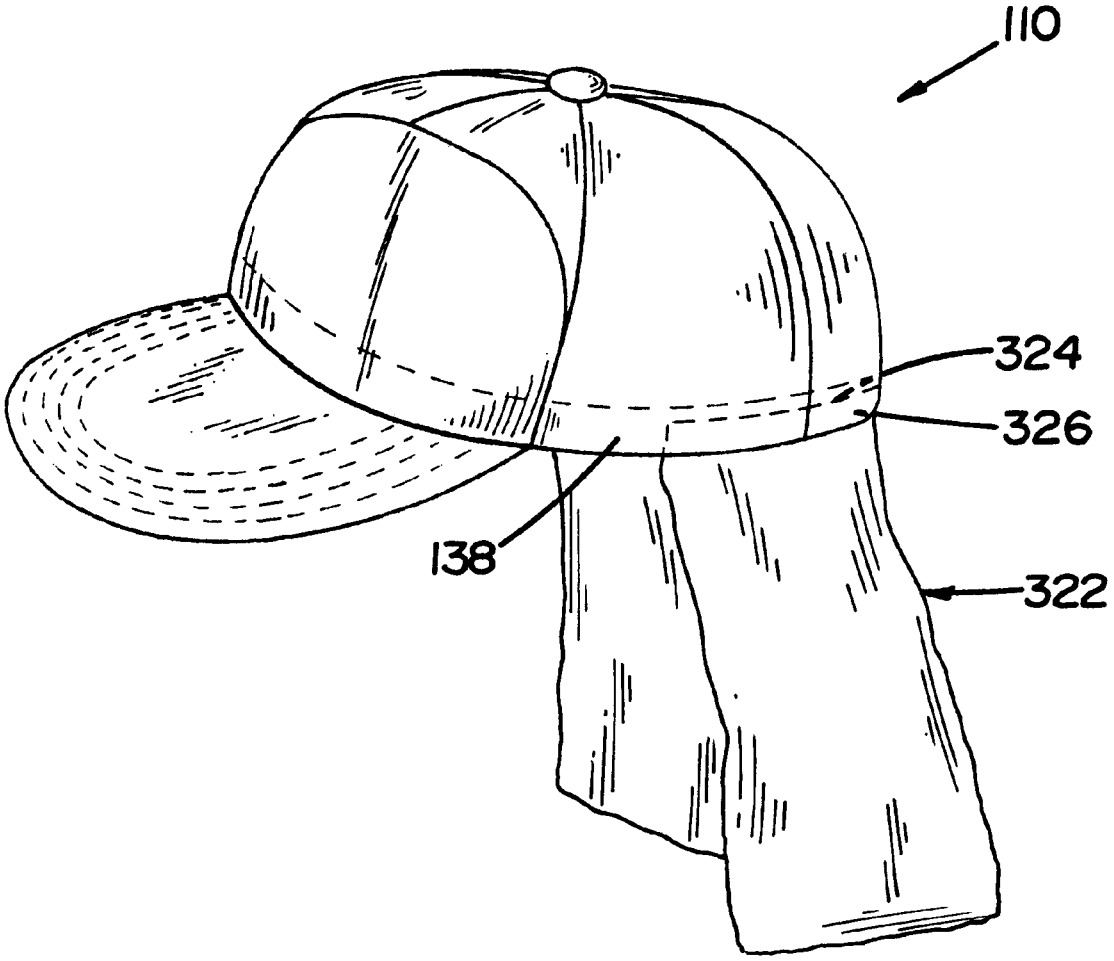
FIG. 18 is a perspective view of an ornamental towel attached to the hat.

FIG. 18 shows an ornamental towel 322 attached to the hat 110. The towel 322 includes a first edge 324 and a connecting member 326, preferably VELCRO hook-type material, attached to the first edge 324. To attach the towel 322 to the hat 110, the user attaches the connecting member 326 to the headband connecting member 138 of the hat 110. When attached to the hat 110, the towel 322 extends downwardly to cover the side of the user's head.

The components discussed above can be attached to the headband in an unlimited variety, since the headband connecting member is thick enough to accommodate the attachment of more than one components at a time. It should also be understood that other components could be incorporated into the present invention, without departing from the spirit of the present invention.

The present modular hat expands traditional functions of today's head wear. The hat allows the removal and attachment of a variety of functional items to and from the headband. For example, when the headband is combined with a visor and a crown, a baseball hat is formed. Despite the outward appearance of an average hat, the internal design of the present hat allows a multiplicity of functional items to be used in any combination to adapt any style; that is, any combination of colored attachments, insignias or advertisements may be removably attached simultaneously or independently to the headband.

While the preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. A modular hat comprising:

a hat crown including an inside perimeter, a front side, a front side, a back side, a left side, and a right side;

a visor attached to the front side of the hat crown;

a headband connecting member attached along the inside perimeter of the hat crown, for releasably connecting a plurality of components to the hat;

and a flashlight holder having a holder with a first edge, a second edge, and connecting member attached to the first edge of the flashlight holder, wherein the connecting member is used to releasably attach the flashlight holder to the headband connecting member.

2. The modular hat according to claim 1, including a chin strap having a string with a first end, a second end, a first fastening member attached to the first end of the string, a second fastening member attached to the second end of the string, and an adjustment clamp attached to the chin strap, wherein the first and second fastening members releasably secure the chin strap to the headband connecting member such that the user may adjust the chin strap to secure the hat in position.

3. The modular hat according to claim 1, including a sunglass mount having a first resilient cord and a second resilient cord, the first cord having a first end, a second end, a first fastening member attached to the first end of the first cord, and a first loop formed at the second end of the first cord for releasable attachment to the modular hat, the second cord having a first end, a second end, a second fastening member attached to the first end of the second cord for releasable attachment to the modular hat, and a second loop formed at the second end of the second cord, wherein the first loop is used to attach the first cord to a right arm of a pair of sunglasses and the second loop is used to attach the second cord to a left arm of a pair of sunglasses, such that the user may simultaneously wear the hat and sunglasses.

4. The modular hat according to claim 1, including an ear muff attachment having a proximal end, a distal end, and an adjustment gap flap attached to the proximal end of the ear muff attachment.

5. The modular hat according to claim 1, including a storm visor having a proximal end, a distal end, an adjustment gap flap attached to the proximal end of the storm visor, a semi-rigid support member attached to the distal end of the storm visor, and a connecting member secured to the proximal end of the storm visor.

6. The modular hat according to claim 1, including an ear and neck winter guard having a proximal end, a distal end, an outer surface, an inner surface, a first neck guard extension, a second neck guard extension, a proximal end connecting member secured to the proximal end of the ear and neck winter guard, a first neck guard extension connecting member secured to the first neck guard extension, and a second neck guard extension connecting member secured to the second neck guard extension, and wherein the proximal end connecting member and the first and second neck guard extension connecting members are used to secure the ear and neck winter guard to the headband connecting member such that the ear and neck winter guard extends downwardly and forwardly over the ears of the user, wrapping around the neck of the user.

7. The modular hat according to claim 1, including a hydration curtain having a distal end, a proximal end, and a connecting member attached to the proximal end of the hydration curtain.

8. The modular hat according to claim 1, including a pocket having a lower end, an upper end, a connecting member attached to the lower end of the pocket, and an opening near the upper end of the pocket, wherein the connecting member located at the lower end of the pocket is used to releasably secure the pocket to the headband connecting member such that the pocket extends upwardly along the inside of the hat crown.

9. The modular hat according to claim 1, including a bug net formed from a mesh material.

10. The modular hat according to claim 1, including an internal headband having an absorbent strip with a first side, a second side, and a connecting member attached to the second side of the strip, wherein the connecting member of the internal headband is used to releasably secure the internal headband to the headband connecting member such that the hat secures the first side of the internal headband in place against the user's head.

11. The modular hat according to claim 1, including a reflective illuminator having a flexible strip with a first reflective side, a second side, and a connecting member, wherein the connecting member is releasably secured to the headband connecting member such that the first reflective side faces outwardly.

12. The modular hat according to claim 1, including a winter facemask having a first pocket, a second pocket, a first corner, a second corner, a first connecting member attached to the first corner, and a second connecting member attached to the second corner, wherein the first and second connecting members are used to releasably attach the facemask to the headband connecting member such that the headband extends downwardly and the first and second pockets are aligned with the left and right ear of the user, respectively.

13. The modular hat according to claim 1, including an ornamental towel having a proximal edge, a distal edge, and a connecting member attached to the proximal edge of the towel, wherein the connecting member is used to secure the towel to the headband connecting member of the hat.

* * * * *